US011293284B2

(12) United States Patent
Cheng et al.

(10) Patent No.: US 11,293,284 B2
(45) Date of Patent: Apr. 5, 2022

(54) UMBRELLA-SHAPED ANCHOR FOR QUICK REINFORCEMENT OF ROCK MASS, AND APPLICATION METHOD

(71) Applicant: Changjiang River Scientific Research Institute, Wuhan (CN)

(72) Inventors: Yonghui Cheng, Wuhan (CN); Yong Xiong, Wuhan (CN); Hang Chen, Wuhan (CN); Shenggang Hu, Wuhan (CN); Jiali Ren, Wuhan (CN); Zunyang Ding, Xiaogan (CN)

( * ) Notice: Subject to any disclaimer, the term of this patent is extended or adjusted under 35 U.S.C. 154(b) by 0 days.

(21) Appl. No.: 17/053,290

(22) PCT Filed: Aug. 12, 2019

(86) PCT No.: PCT/CN2019/100266
§ 371 (c)(1),
(2) Date: Mar. 23, 2021

(87) PCT Pub. No.: WO2020/206893
PCT Pub. Date: Oct. 15, 2020

(65) Prior Publication Data

US 2021/0246787 A1 Aug. 12, 2021

(30) Foreign Application Priority Data

Apr. 12, 2019 (CN) ..... 201910292672.7

(51) Int. Cl.
*E21D 21/00* (2006.01)
*E02D 5/74* (2006.01)
(Continued)

(52) U.S. Cl.
CPC ..... *E21D 21/0026* (2013.01); *E02D 5/74* (2013.01); *E21D 20/003* (2013.01); *E21D 20/02* (2013.01); *E21D 21/008* (2013.01)

(58) Field of Classification Search
CPC combination set(s) only.
See application file for complete search history.

(56) References Cited

U.S. PATENT DOCUMENTS

2012/0034035 A1* 2/2012 Sligar ..... E21D 21/006 405/259.1

FOREIGN PATENT DOCUMENTS

CN 87200415 U 11/1987
CN 2208100 Y 9/1995
(Continued)

*Primary Examiner* — Kyle Armstrong
(74) *Attorney, Agent, or Firm* — Keith Swedo

(57) ABSTRACT

The invention provides an umbrella-shaped anchor for rapid reinforcement of rock mass. The umbrella-shaped anchor for rapid reinforcement of the rock mass comprises an umbrella-shaped anchor head and a connecting rod. The umbrella-shaped head comprises the sliding mechanism, bearing block, guide block and main rod of anchor head. The main rod of anchor head is connected with the sliding mechanism after passing through the through-hole located in the middle of the guide block The sliding mechanism is connected with the connecting rod through the main rod of the anchor head. The multiple upper parts of bearing blocks are respectively inserted into the groove of the guide block, and they are fully fitted with the side guide rail of the sliding mechanism During installation, after the umbrella anchor head and connecting rod in the retracted state are extended into the anchor hole, the connecting rod is tensioned to drive the sliding mechanism to extrude the bearing block to open outwards and squeeze with the hole surface. The invention converts the tensile force of the anchor rod into the extrusion pressure on the rock mass, and obtains the larger anchoring force by using the higher compressive strength of the rock mass. The invention has the advantages of large applicable depth, fast construction speed, high efficiency, no grouting, large structural resistance and good stability.

5 Claims, 6 Drawing Sheets

(51) Int. Cl.
*E21D 20/00* (2006.01)
*E21D 20/02* (2006.01)

(56) References Cited

FOREIGN PATENT DOCUMENTS

| | | | | | |
|---|---|---|---|---|---|
| CN | 200971785 | Y | | 11/2007 | |
| CN | 103334780 | A | | 10/2013 | |
| CN | 203879522 | U | | 10/2014 | |
| CN | 110043300 | A | | 7/2019 | |
| GB | 1045161 | A | * | 10/1966 | ..... E21D 21/008 |
| JP | 2016011504 | A | | 1/2016 | |

* cited by examiner

UMBRELLA-SHAPED ANCHOR FOR QUICK REINFORCEMENT OF ROCK MASS, AND APPLICATION METHOD

FIELD OF THE PRESENT INVENTION

The present invention relates to the technical field of rock mass reinforcement, in particular to an umbrella-shaped anchor for rapid reinforcement of rock mass and an application method

BACKGROUND OF THE PRESENT INVENTION

Rock mass anchoring technology is to connect the formation and the rock mass tightly by the anchor rod embedded in the rock mass, and rely on the shear strength of the rod and surrounding rock mass to resist the tensile force of the formation or to reinforce the rock mass itself, so as to maintain the stability of the formation and the rock mass. Rock anchor rod is widely used in rock slope, tunnel, anti-floating foundation, anti-dumping foundation and other geotechnical structures in highway, railway, water conservancy, construction, power transmission and transformation, mining and other engineering construction.

The methods of rock mass anchoring mainly include the grouting anchor rod and mechanical anchoring at present.

The grouting anchor rod is to inject cement slurry into the borehole to bond the anchor rod with rock to form anchor solid. But it can only play a role after the age of cement slurry solidification, and the process is complex, the grouting quality is difficult to control, and the construction needs more instruments and equipment.

Mechanical anchoring is to directly use the resistance of rock mass to provide the anchoring force required for reinforcement. After the installation is completed, it can play a role, such as wedge slot anchor rod, inverted wedge anchor rod, expansion shell anchor rod, etc.

Wedge slot anchor rod is a kind of mechanical anchor rod whose end is cut with round steel at the end and inserted wedge into the wedge joint. After the rod body is inserted into the anchor hole during installation, the iron wedge is expanded and the anchor head in the cutting seam is pressed against the hole surface by hammering, and the anchoring force is provided by the friction resistance generated. It is mainly used to reinforce surrounding rock during construction or in caverns with short service life, so as to prevent block stone from collapsing. However, the anchorage force provided is small and will decrease with time.

Inverted wedge anchor rod is a kind of mechanical anchor whose end is composed of fixed wedge and movable wedge which are inverted each other. When installing, after the rod body is inserted into the anchor hole, the movable wedge is pushed into the inclined plane of the fixed wedge with a metal rod, and the fixed wedge is tightly fixed in the hole, and the anchoring force is provided by the friction resistance generated. A kind of extensible and recyclable metal inverted wedge anchor (Patent No.: ZL201520264858.9) invented by Tang Hai et at The anchoring part adopts inverted upper and lower wedges. During installation, the upper and lower wedges are tied together and sent into the anchor hole, and then the metal rod is used to knock the upper wedge for anchoring. However, the upper and lower wedges, i.e. the fixed wedge and the movable wedge, are completely separated. When they are sent into the anchor hole, they are easy to collide with the rock wall, resulting in the change of relative position and even detachment. Moreover, the metal rod is required to knock and makes the movable wedge tight. It is suitable for small depth, small anchoring force and the quality is difficult to guarantee.

Expansion shell anchor rod is a kind of mechanical anchor rod whose end is composed of expanding shell and conical nut (wedge). During installation, the rod body is rotated to make the conical nut slide downward, forcing the expansion shell to open outwards, and the wedge is embedded into the rock wall of the drilling hole, and the wedge becomes more and more firm with the continuous rotation of the rod body. However, during installation, the expansion anchor rod needs to hold the wedge and the expanded shell piece against the bottom of the anchor hole, and then rotate the anchor rod to make the expansion shell piece open. If the lateral displacement occurs when the bolt is rotated, it will make the expanded shell and surrounding rock not bite firmly, and the anchoring effect is bad. The expansion shell plate of some s shell anchor rod can not only slide along the wedge surface of the wedge, but also be free to break off radially, which makes it easy for the anchor head to occlude with the surrounding rock in the process of sending into the designated position of the anchor hole, resulting in the construction difficulty of the anchor rod and even the waste hole. Wang Runzhong and others developed a kind of expansion shell anchor rod (Patent No.: 71201420125404.9) to solve the problem. The expansion shell plate is limited in the wedge groove by pulling rope and elastic rope to prevent the expansion plate from occluding with the surrounding rock in the middle of the lower end of the wedge body to avoid the lateral displacement by the downward protruding tip. But in the process of construction, the blocking situation of the shell expansion plate is different, the spring rope fixation effect is not good, and it is easy to break due to friction with rock wall, which increases the construction difficulty.

Umbrella-shaped anchor rod is widely used in soil reinforcement. The umbrella-shaped anchorage (Patent No. CN97103512.1) invented by Zhang Jihong and others, and a special percussive umbrella-shaped anchor invented by Cheng Zhanlin (Patent No.: 71201510413982.1) and others, all use the opened anchor plate to extrude the soil to form the anchorage area, and use the shear strength of the soil to obtain the anchoring force. However, the properties of rock mass are very different from that of soil, so the anchor plate of umbrella-shaped anchor used for soil reinforcement cannot be opened in rock mass and can not be applied in rock mass.

SUMMARY OF THE PRESENT INVENTION

In view of the shortcomings of the existing rock anchor rod and soil umbrella-shaped anchor, the present invention provides an umbrella-shaped anchor for fast anchoring of rock mass and an application method. After the drilling equipment is used to form the hole, the umbrella shaped anchor under the retracted state is sent to the predetermined anchorage position. The bearing block opens outwards by tension against the hole surface to reach the predetermined anchorage force and the anchoring force can be formed after the final locking. The invention converts the tensile force of the anchor rod into the extrusion force on the rock mass, and obtains the larger anchoring force by using the higher compressive strength of the rock mass. The whole process is very simple, suitable for large depth, fast construction speed, high efficiency, large structural resistance, good stability and controllable quality.

The invention solves the technical problem by the following technical scheme:

The umbrella-shaped anchor used for rapid reinforcement of rock mass is comprised of the umbrella-shaped Anchor head and the connecting rod that is connected with the umbrella-shaped Anchor head. The umbrella-shaped anchor head includes the sliding mechanism, the bearing blocks, the guide block, and the main rod of the anchor head.

The main rod of the Anchor head is connected with the sliding mechanism after passing through the through-hole located in the middle of the guide block, and the sliding mechanism is connected with the connecting rod through the main rod of the anchor head, and the multiple of upper parts of the bearing blocks are respectively inserted into the grooves of the guide blocks, and are fully fitted with the side guide rails of the sliding mechanism. During installation, after the umbrella anchor head in the retracted state and the connecting rod are extended into the anchor hole, using the casing against the guide block, When the connecting rod is tensioned upward, it will drive the sliding mechanism to move upward, and the bearing blocks will open outward along the groove of the guide block under the extrusion pressure of the sliding mechanism, similar to the umbrella shape, until the outer surface of the bearing blocks contacts the hole surface. The anti-sliding device works to prevent the sliding mechanism from moving downward and separating from the bearing blocks. And the bearing blocks keeps tensioning to reach the predetermined anchor force when the casing to be taken out.

Furthermore, the connecting rod is equipped with the pre-stressed steel strands according to the needs, and is connected with the umbrella-shaped anchor head.

Furthermore, the umbrella-shaped anchor used for rapid reinforcement of rock mass also includes the bearing plate and locking device. The bearing plate is used to be sheathed on the connecting rod protruding from the rock mass. The locking device is used to lock the connecting rod and bearing plate extending out of the rock mass and forms a whole.

Furthermore, therein said locking device comprises a sleeve and a pipe slip. The sleeve is a ring made of metal, and the middle part is an inverted circle-shaped cavity for passing through the connecting rod. The pipe slips are installed in the wedge gap between the sleeve and the connecting rod, and locks the connecting rod and the sleeve with the bearing plate and forms a whole.

Furthermore, the slide mechanism is a hexahedron with a small upper and a large lower square section. There is a guide rail with the rectangular section in the middle of the inclined plane. The inclined angle is 70°~88° and the height is 100 mm~400 mm.

Furthermore, the outer surface of wherein said bearing blocks is of circular arc shape, and the inner surface of the bearing blocks is engaged with the sliding mechanism. The bearing blocks can have the relative sliding movement along the guide rail of the sliding mechanism. The upper part of the sliding mechanism can be inserted into the groove of the guide block and slide along the groove.

Furthermore, therein said guide block is a cylinder with a groove around and a square hole in the middle. The square hole allows the main rod of the anchor head to get past. There are four notches and evenly distributed on the guide block. The notch only allows the bearing blocks to slide laterally.

Furthermore, therein said reverse anti-sliding device is arranged between the main rod of the anchor head and the guide block, between the top of the bearing blocks and the guide block, and between the sliding mechanism and the bearing blocks with the model of spring limit device. After the bearing block and the sliding mechanism slide relative to each other, the reverse anti-sliding device can limit the downward movement of the sliding mechanism and separate from the bearing blocks after opening and contacting extrusion with the hole surface.

The application method of the umbrella-shaped anchor for rapid reinforcement of rock mass includes the following steps:

Step 1. Turn on the drilling equipment and drill into the rock body until the predetermined depth is reached. Remove the drilling equipment. The umbrella-shaped anchor head is connected with the connecting rod, the umbrella-shaped anchor head in the retracted state and the connecting rod are extended into the anchor hole, and the second connecting rod is connected until the design anchorage depth is reached.

Step 2. Put the sleeve out of the connecting rod (2) into the anchor hole until it is against the guide block (7). The connecting rod (2) is tensioned outwards, and the sliding mechanism (5) moves upward to squeeze the bearing blocks (6) to open like an umbrella until the outer wall of the bearing block (6) contacts with the hole surface.

Step 3. Take out the sleeve and the reverse anti-sliding device makes the sliding mechanism not to be separated from the bearing blocks downward. Install the bearing plate and the locking device. Then the jack with large stroke hollow is installed on the construction platform and the bearing plate, and the jack is clamped with the connecting rod with the pipe slips.

Step 4. Start the jack and tension the connecting rod at the end. When the tension indicated by the jack pressure gauge reaches the predetermined anchoring force, the connecting rod and the bearing plate are locked with the locking device to form a whole, and the installation is completed.

Grouting or anti-corrosion coating can be carried out according to the requirements in case of anti-corrosion requirements.

The umbrella-shaped anchor for rapid reinforcement of rock mass and its application method have the following advantages over the previous reinforcement technology:

(1) Through the force transmission way of connecting rod, the main rod of the anchor head, the sliding mechanism and bearing block, the tensile force of anchor rod is converted into the squeezing force on rock mass, and the greater the tension, the greater the squeezing force on rock mass, and the greater the anchoring force. Different from the friction type anchor rod, the invention uses the higher compressive strength of rock mass to obtain larger anchoring force, and has large structural resistance, which can ensure no damage under the predetermined anchoring force (2) When the umbrella anchor head in the retracted state is extended into the anchor hole, the bearing blocks are not easy to occlude with the borehole wall of the rock mass in the middle. After reaching the designed anchorage position, the guide block is pressed against the post tensioning connecting rod with the sleeve, and the bearing block is opened along the groove of the guide block and occluded with the rock mass under the extrusion of the sliding mechanism. The tensioning stroke is controllable, with good stability and no need to resist the bottom of the anchor hole. The anchorage position can be controlled according to the length of connecting rod, which can ensure the construction quality.

(3) The umbrella-shaped anchor does not need grouting and provides anchoring force by using the resistance of rock mass itself. After construction, it can play a role and overcome the disadvantages of poor grouting quality and time long age.

(4) The external surface of the bearing blocks is circular, which can fully contact with the rock mass of the hole surface. The bearing blocks have the large stress area, long effective working length and large anchoring force. And the bearing blocks are extruded by the sliding mechanism, and the center of travel is symmetrical, and the surrounding rock mass is evenly squeezed, and the rock mass is under uniform stress.

(5) After the completion of drilling, the installation of the umbrella-shaped anchor in rock mass only needs tensioning. The process is very simple, the installation speed is fast and the efficiency is high.

(6) The umbrella-shaped anchor head only opens in tension, so the anchorage angle is widely used. It can be used for slope, structure foundation and other geotechnical structures reinforcement, including overall anti-sliding, horizontal anti-sliding, anti-floating and anti-toppling.

In the view, 1—the umbrella-shaped anchor head;
2—the connecting rod;
3—the bearing plate;
4—the locking device;
5—the sliding mechanism
6—the bearing block;
7—the guide block;
8—the main rod of the anchor head;
9—the reverse anti-sliding device;
10—the connecting device;
11—the groove of the guide block;
12—the guide rail with the rectangular section

DETAILED DESCRIPTION OF THE PREFERRED EMBODIMENTS

Figure 1:
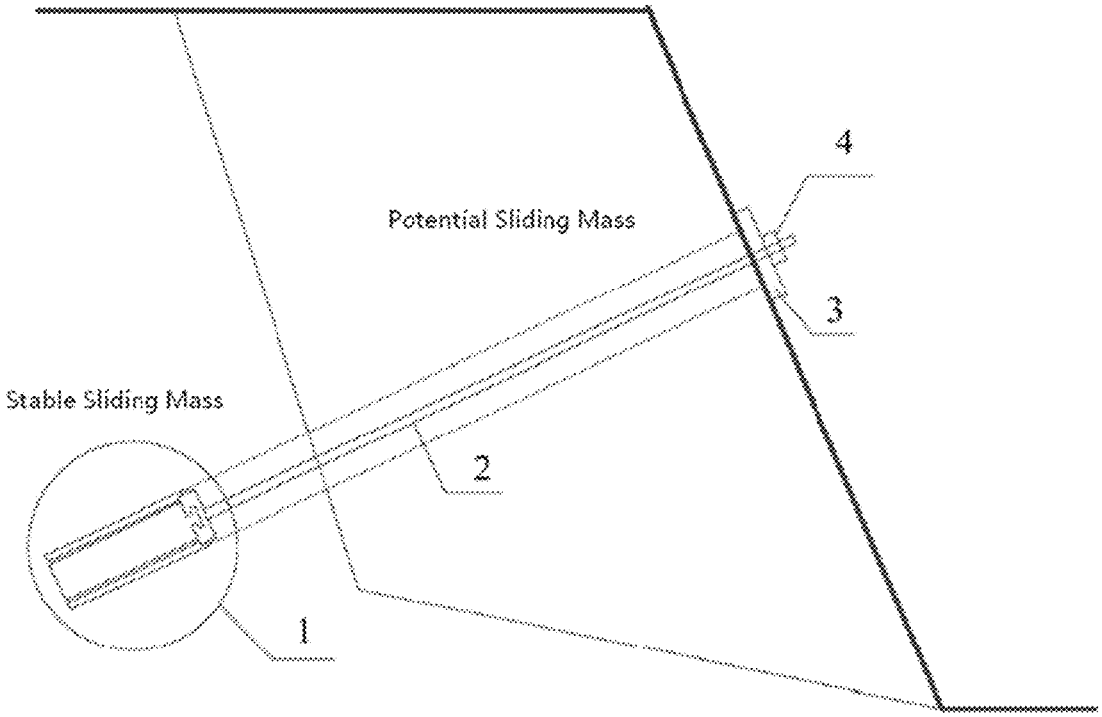
FIG. 1 is the structural view of the umbrella-shaped anchor for rapid reinforcement of rock mass in the present invention.

The technical scheme of the invention will be described clearly and completely in combination with the views in the invention as below:

Referring to FIG. 1, the present invention provides an umbrella-shaped anchor for rapid reinforcement of rock mass, including the umbrella-shaped anchor head 1, the connecting rod 2, the bearing plate 3 and the locking device 4.

Figure 2:
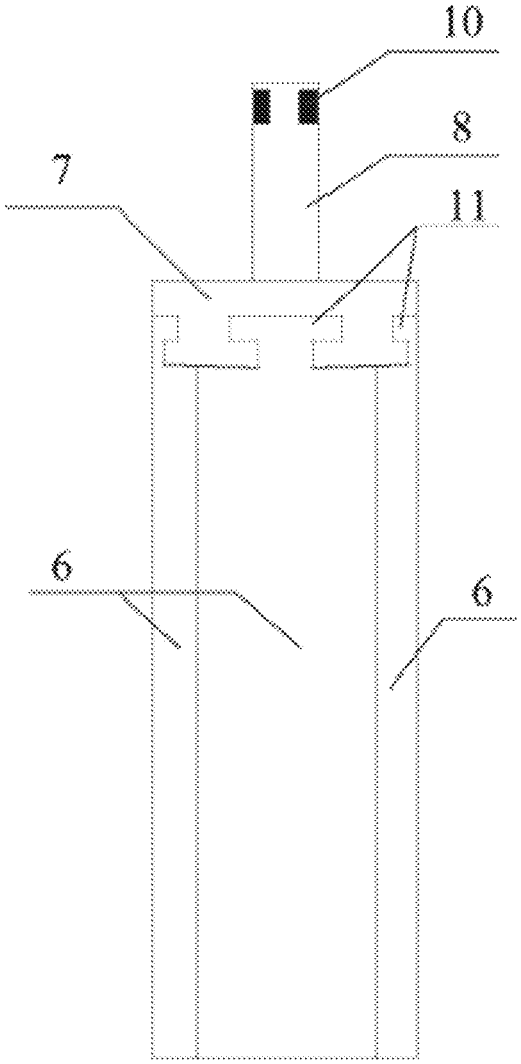
FIG. 2 is the side view of the umbrella-shaped anchor used for rapid reinforcement of rock mass in the present invention.
Figure 3A:
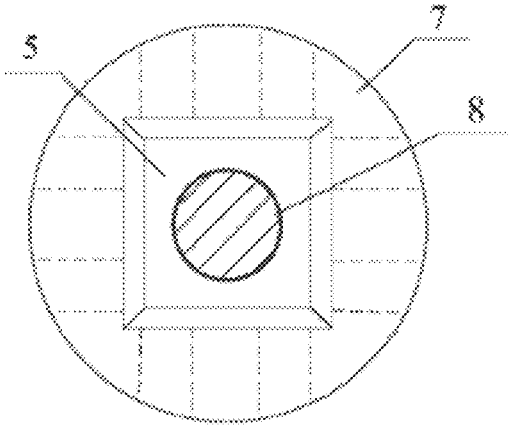
FIG. 3 (*a*) is the top view of the retracted state of the umbrella-shaped anchor for rapid reinforcement of rock mass, and FIG. 3 (*b*) is the bottom view of the umbrella-shaped anchor used for rapid reinforcement of rock mass in the present invention.
Figure 3B:
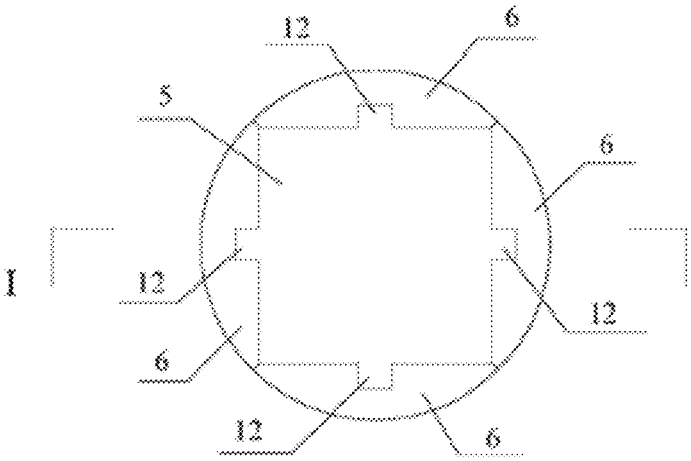
Figure 4A:
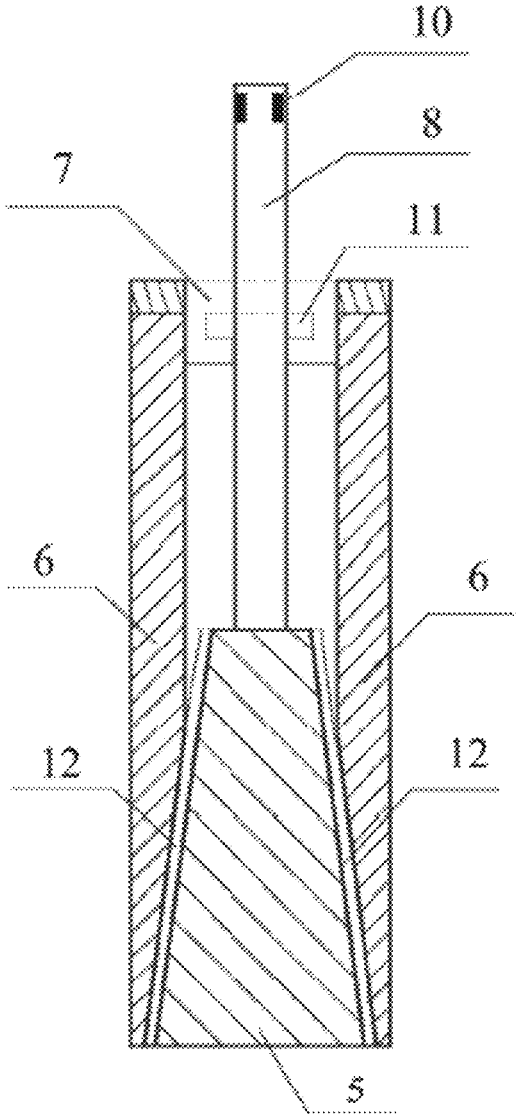
FIG. 4 (*a*) is the section view of the retracted state of the umbrella-shaped anchor head used for rapid reinforcement of rock mass in the retracted state, and FIG. 4 (*b*) is the section view of the expansion state of the umbrella type anchor head for rapid reinforcement of rock mass in the present invention.
Figure 4B:
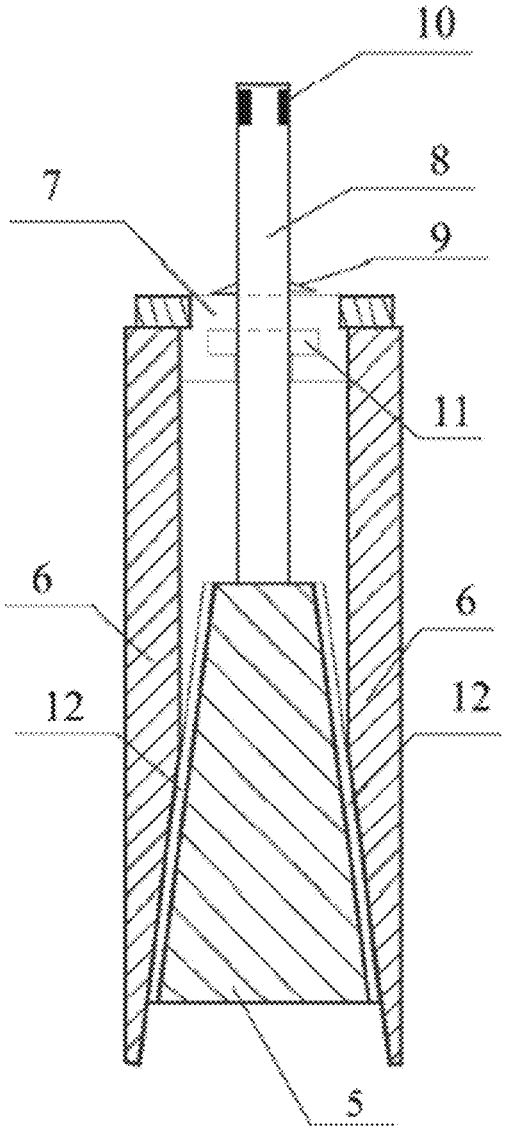

Furthermore, referring to FIG. 2 to FIG. 4, the umbrella-shaped anchor head 1 includes the sliding mechanism 5, the bearing block 6, the guide block 7 and the main rod of the anchor head 8. The main rod of the anchor head 8 passes through the through-hole in the middle of the guide block 7, and the eliding mechanism 5 is connected with the connecting rod 2 through the main rod of the anchor head 8. The upper parts of each bearing block 6 are respectively inserted into the groove of the guide block 11, and the eliding mechanism 5 is completely wrapped and contacted. The diameter of the anchor head is smaller than the diameter of the anchor hole in the retracted state, so it is easy to extend into the hole.

The sliding mechanism 5 is a hexahedron with a small upper and a large square cross-section at the bottom. There is a rectangular section guide rail 12 in the middle of the inclined plane. The elope angle is 70° to 88° and the height is 100 mm to 400 mm.

The upper part of bearing block 6 can be inserted into groove of guide block 11 (as shown in FIG. 2) and can be slid in groove of guide block 11. The outer surface of the bearing block 6 is circular arc, and the middle part of the inner surface is provided with a rectangular groove (as shown in FIG. 3 (*b*)), which fits with the guide rail with the rectangular section 12 of the eliding mechanism 5, and can be slid relative to the guide rail of the eliding mechanism 5.

The guide block 7 is a cylinder with grooves around and the hole in the middle. The hole is square and can allow the connecting rod 2 to pass through (as shown in FIG. 2 (*a*)). There are four grooves of the guide block 11 and they are evenly distributed. The notch matches the shape of the upper part of the bearing block 6. After the bearing block 6 is inserted into the guide block 7, the notch only allows the bearing blocks to slide laterally.

The reverse anti-sliding device 9 is arranged between the main rod of the anchor head 8 and the guide block 7, between the top of the bearing block 6 and the guide block 7, and between the sliding mechanism 5 and the bearing block 6 with the model of spring limit device etc. After the bearing blocks 6 and the sliding mechanism 5 slide relative to each other, the reverse anti-sliding device 9 (as shown in FIG. 4 (*b*)) can limit the downward movement of the sliding mechanism 5 and separate from the bearing blocks 6 after opening and contacting extrusion with the hole surface.

The connecting rod 2 is a thick wall steel pipe which can bear the tensile force required for anchoring. The prestressed steel strand is set inside according to the needs, and the single length of the strand is 1-2 m. The umbrella-shaped anchor head 1 is connected with the connecting rod 2 by a connecting device 10. The connecting device 10 is arranged at the end of the main rod 8 of the anchor head. When only steel pipe is used to connect with anchor head 1, connection device 10 can be threaded connection. When the steel strand is used, the connection device 10 can be used as the anchorage device of the steel strand.

The bearing plate 3 is a square or circular metal component that bears the pressure required for anchoring. The bottom surface of bearing plate 3 (the side in contact with rock mass) is a smooth plane. The top surface of the bearing plate 3 can be ribbed according to the stress requirements. The bending deformation of bearing plate 3 should not exceed 1% under the design stress condition.

The locking device comprises a sleeve and a pipe slip. The sleeve is a ring made of metal, and the middle part is an inverted circle-shaped cavity for passing through the connecting rod 2. The pipe slips are installed in the wedge gap between the sleeve and the connecting rod, and locks the connecting rod 2 and the sleeve with the bearing plate 3 and forms a whole.

In the initial state, the four bearing blocks 6 are completely embedded in the groove of the guide block 11 and are close to the periphery of the sliding mechanism 5. When used, the umbrella-shaped anchor head 1 in the retracted state and the connecting rod 2 are extended into the drilled anchor hole and are reached the design position. Then the sleeve is used to resist the guide block 7. When the connecting rod 2 is tensioned upward, the sliding mechanism 5 is driven to move upward, and the bearing block 6 opens outward along the groove of the guide block 11 under the extrusion force of the sliding mechanism 5 (as shown in FIG. 4 (*b*)), until the outer wall of the bearing block 6 contacts the hole wall. The reverse anti-sliding device 9 works to prevent the sliding mechanism 5 from moving downward and separating from the bearing block 6. Take out the sleeve and continue to stretch to reach the predetermined anchor force.

Figure 5:
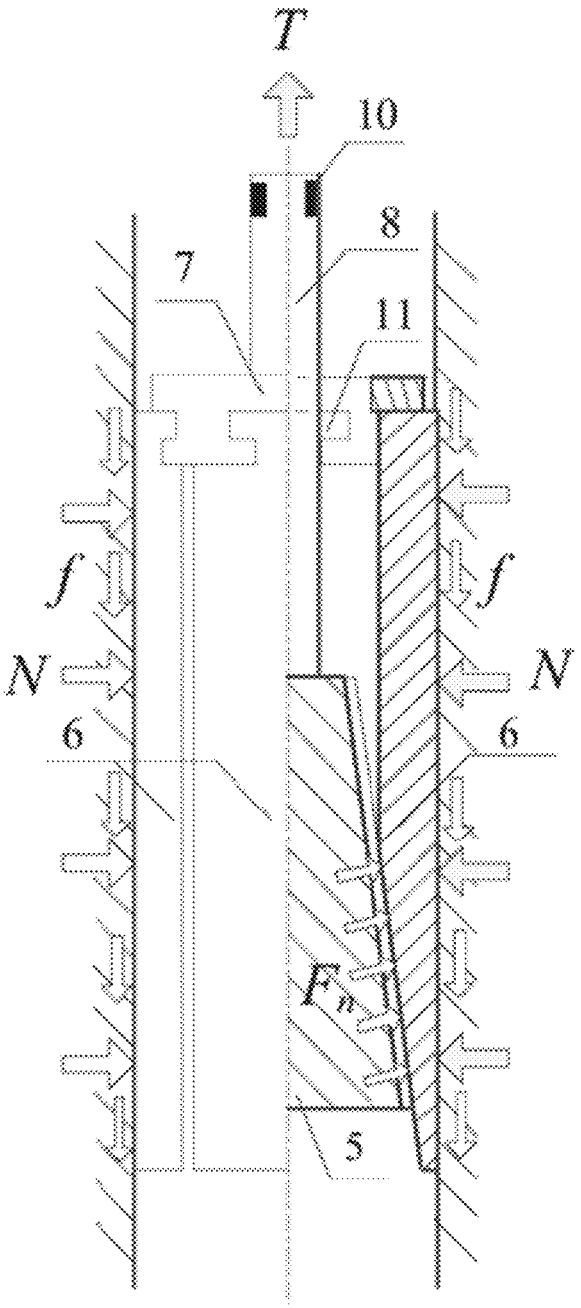
FIG. 5 is the stress schematic view of the umbrella-shaped anchor for rapid reinforcement of rock mass in the present invention.

Referring to FIG. 5, the load-bearing principle of the invention is that the tensile force Ton the connecting rod 2, which is used to reinforce the rock mass to prevent its sliding, causes the sliding mechanism 5 to move upward and extrude the bearing block 6, thus producing a squeezing force F. on the interface. The bearing block opens outward and extrudes the rock mass to produce squeezing force N, and the rock mass prevents the anchor rod from moving upward and produces static friction force f, and f=T in steady state. Within the range of compressive strength of rock mass, the tensile force T is proportional to the extrusion force N. When the wedge ratio of sliding mechanism 5 is appropriate, the tensile force T is always less than the limit value AN of sliding between bearing block 6 and rock mass. The μ is the sliding friction coefficient, that is, the umbrella-shaped anchor and the rock mass will only become more and more tight, and there will be no relative slide. Theoretically, as long as the rock mass and umbrella-shaped anchor do not destroy, the anchoring force is infinite. Due to the high compressive strength of rock mass, the present invention can make full use of its compressive strength to obtain larger anchoring force.

The present invention provides an application method of umbrella-shaped anchor for rapid reinforcement of rock mass, including the following steps (taking slope as an example):

Step 1. Turn on the drilling equipment and drill into the rock body until the predetermined depth is reached. Remove the drilling equipment. The umbrella-shaped anchor head 1 is connected with the connecting rod 2, the umbrella-shaped anchor head 1 in the retracted state and the connecting rod 2 are extended into the anchor hole, and the second connecting rod 2 is connected until the design anchorage depth is reached.

Step 2. Put the sleeve out of the connecting rod 2 into the anchor hole until it is against the guide block 7. The connecting rod 2 is tensioned outwards, and the sliding mechanism 5 moves upward to squeeze the bearing blocks 6 to open like an umbrella until the outer wall of the bearing block 6 contacts with the hole surface.

Step 3. Take out the sleeve and the reverse anti-sliding device 9 makes the sliding mechanism 5 not to be separated from the bearing blocks 6 downward. Install the bearing plate 3 and the locking device 4. Then the jack with large stroke hollow is installed on the construction platform and the bearing plate 3, and the jack is clamped with the connecting rod 2 with the pipe slips.

Step 4. Start the jack and tension the connecting rod 2 at the end. When the tension indicated by the jack pressure gauge reaches the predetermined anchoring force, the connecting rod 2 and the bearing plate 3 are locked with the locking device to form a whole, and the installation is completed.

The above-mentioned content is only a detailed description of the preferred embodiment provided by the present invention. However, the protection scope of the invention is not limited to that. Any change or replacement that can be easily thought of by a person skilled in the technical field within the scope of the present invention disclosed shall be included in the scope of protection of the present invention. Therefore, the protection scope of the present invention shall be subject to the protection scope of the claim.

What is claimed is:

1. An umbrella-shaped anchor for rapid reinforcement of a rock mass, said umbrella-shaped anchor comprising:

an umbrella-shaped anchor head (1), the umbrella-shaped anchor head (1) including:

a guide block (7) having a through-hole and a plurality of grooves;

a main rod (8) extending through the through-hole of the guide block (7);

a reverse anti-sliding device (9) engaging the main rod (8);

a sliding mechanism (5) having a plurality of side guide rails, the sliding mechanism (5) being connected to the main rod (8); and a plurality of bearing blocks (6) having a plurality of parts, each of the parts being disposed in a respective one of the grooves of the guide block (7), the bearing blocks (6) engaging the side guide rails of the sliding mechanism (5);

a bearing plate (3);

a locking device (4) including a sleeve; and a connecting rod (2) connected to the umbrella-shaped anchor head (1) and locked to the bearing plate (3) by the locking device (4), the connecting rod (2) being connected with the sliding mechanism (5) through the main rod (8), the connecting rod (2) being configured to be inserted in an insertion direction along with the umbrella anchor head (1) into an anchor hole of the rock mass while the anchor head (1) is in a retracted state and the sleeve is engaging against the guide block (7), such that when the connecting rod (2) is tensioned in the insertion direction, the connecting rod (2) drives the sliding mechanism (5) to move in the insertion direction, and the bearing blocks (6) move in a radially outward direction along the grooves of the guide block (7) under extrusion pressure of the sliding mechanism (5) until the outer surfaces of the bearing blocks (6) engage a surface of the anchor hole, and such that the reverse anti-sliding device (9) prevents the sliding mechanism (5) from moving in a direction opposite to the insertion direction and from separating from the bearing blocks (6), and such that the bearing blocks (6) maintain tension to exert a predetermined anchor force against the surface of the anchor hole, wherein the slide mechanism (5) is a hexahedron with a first surface facing in the insertion direction and a second surface facing in the direction opposite the insertion direction, the second surface being square-shaped and larger than the first surface, the slide mechanism including two opposite rectangular side surfaces each interconnecting the first surface and the second surface, a respective one of the guide rails being on each of the side surfaces, each of the side surfaces being oriented at an angle of approximately between 70° and 88° relative to a direction perpendicular to the insertion direction, each of the side surfaces having a length between the first surface and the second surface approximately between 100 mm and 400 mm, and wherein said guide block (7) is a cylinder with a groove around a perimeter of the cylinder, the guide block (7) having a central square-shaped hole, the square hole being configured to allow the main rod (8) of the anchor head to extend past the guide block (7), the guide block (7) include four evenly spaced notches, the notches being configured to allow the bearing blocks (6) to slide laterally in directions perpendicular to the insertion direction.

2. The umbrella-shaped anchor of claim 1 wherein the connecting rod (2) includes pre-stressed steel strands.

3. The umbrella-shaped anchor of claim 1 wherein the bearing plate (3) is configured to be sheathed on a portion of the connecting rod (2) protruding from the rock mass, the locking device (4) being configured to lock the bearing plate (3) to the portion of the connecting rod (2) extending out of the rock mass.

4. The umbrella-shaped anchor of claim 1 wherein the outer surfaces of said bearing blocks (6) conjunctively have a cylindrical shape, and inner surfaces of the bearing blocks (6) are engaged with the sliding mechanism (5), the bearing blocks (6) being configured to slide along the guide rails of the sliding mechanism (5), an end of the sliding mechanism (5) that includes the first surface being configured to be inserted into one of the grooves of the guide block (7) and to slide along the groove.

5. The umbrella-shaped anchor of claim 1 wherein said reverse antisliding device (9) is disposed between the main rod of the anchor head (8) and the guide block (7), between an end of the bearing block (6) and the guide block (7), and between the sliding mechanism (5) and the bearing blocks (6), the antisliding device (9) being configured to function as a spring limit device, the bearing blocks (6) and the sliding mechanism (5) being slidable relative to each other, the reverse anti-sliding device (9) being configured to limit the movement of the sliding mechanism (5) in the direction opposite the insertion direction and away from the bearing blocks (6) after the bearing blocks (6) have engaged the surface of the anchor hole.

* * * * *